United States Patent [19]

Fransen et al.

[11] 4,128,782

[45] Dec. 5, 1978

[54] GETTER HOLDER AND ELECTRIC DISCHARGE TUBE COMPRISING SUCH A HOLDER

[75] Inventors: Jan J. B. Fransen; Franciscus J. Rimmelzwaan, both of Eindhoven, Netherlands

[73] Assignee: U.S. Philips Corporation, New York, N.Y.

[21] Appl. No.: 798,318

[22] Filed: May 19, 1977

Related U.S. Application Data

[63] Continuation of Ser. No. 613,854, Sep. 16, 1975, abandoned.

[30] Foreign Application Priority Data

Sep. 26, 1974 [NL] Netherlands ..... 7412693

[51] Int. Cl.[2] ..... H01J 61/26

[52] U.S. Cl. ..... 313/174; 313/180; 313/481

[58] Field of Search ..... 313/174, 180, 481; 417/48; 220/68, 69; 227/205

[56] References Cited

U.S. PATENT DOCUMENTS

| | | | |
|---|---|---|---|
| 2,455,514 | 12/1948 | Mead | 51/319 |
| 2,832,223 | 4/1958 | Courand | 277/205 X |
| 3,457,448 | 7/1969 | Scott | 313/174 |
| 3,558,961 | 1/1971 | Palsha | 313/174 |
| 3,620,645 | 11/1971 | Della Porta | 417/48 |

FOREIGN PATENT DOCUMENTS

| | | | |
|---|---|---|---|
| 720039 | 3/1942 | Fed. Rep. of Germany | 277/184 |

*Primary Examiner*—Palmer C. Demeo
*Attorney, Agent, or Firm*—Algy Tamoshunas

[57] ABSTRACT

A body of compressed powder including a gettering material that can be released from the body by heating is held in a getter holder having at least one cavity with a substantially U-shaped cross-section. In order to lock the body in the cavity, at least a part of the inner wall of the cavity has a slight surface unevenness the extent of which is between 0.5 μm and a few tenths of the wall thickness of the holder.

6 Claims, 2 Drawing Figures

GETTER HOLDER AND ELECTRIC DISCHARGE TUBE COMPRISING SUCH A HOLDER

Figure 1:
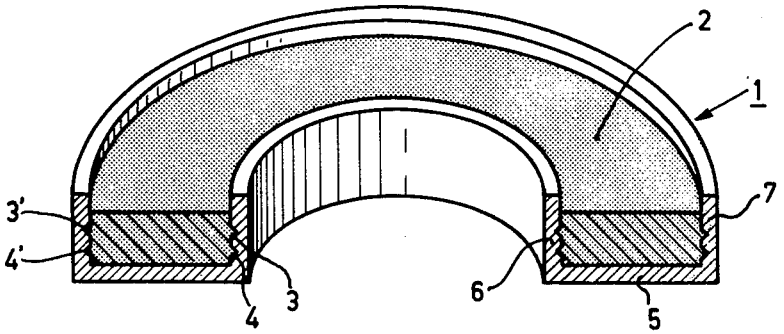

This is a continuation of application Ser. No. 613,854, filed Sept. 16, 1975, now abandoned.

The invention relates to a getter holder having at least one open cavity with a mainly U-shaped cross-section. Disposed in the cavity is a body consisting of compressed powder of a gettering material which can be released from the body at least partly by heating. The getter holder further comprises means for locking the body in the cavity.

The invention further relates to an electric discharge tube comprising such a holder. Such a getter holder is known from the U.S. Pat. No. 3,457,448. This patent describes an endless gutter-shaped holder in which the means to lock the gettering material compressed in the getter consist of a wire secured to the bottom of the gutter-shaped holder and preferably of a projection or constriction in the outer wall of the holder in which case comparatively large deformations are concerned. Since a getter holder is generally stamped from sheet material, such deformations at right angles to the direction of stamping present problems in detaching of the shaped article from the stamping tools.

It is the object of the invention to provide a getter holder with simple means for preventing particles of solid material from being released therefrom during, as well as after, the evaporation of the gettering material.

According to the invention, in a getter holder comprising at least one open cavity having a mainly U-shaped cross-section, the means to lock the filling in the holder includes of a surface unevenness extending at least over a portion of the inner wall of the cavity.

The invention is based on the recognition of the fact that for good locking of a compressed gettering powder can be obtained without the need for relatively large deformations in the walls of the holder. A slight surface unevenness is sufficient to realize the end envisaged with the invention. As compared with known means for locking the gettering material the invention has the advantage that a slight surface unevenness can be obtained in a simple manner.

According to the invention, the surface unevenness preferably includes at least one groove in at least one of the side walls of the cavity which extends substantially parallel to the bottom plane of the cavity. Such a groove is provided in the sheet material before shaping the holder and the depth thereof is only one to a few tenths of the wall thickness of the holder.

According to a favourable embodiment of the invention, the inner wall of the getter holder has an average surface roughness of at least 0.5 $\mu$m. (The roughness is sometimes expressed in the unit "ru" where 1 ru = 1 micro inch $\approx$ 1/40 $\mu$m). According to the invention such roughnesses can be obtained in a simple manner by sand-blasting or chemically. These operations can be carried out prior to or after the formation of the holder. There is however, a slight advantage in roughening the side walls after the formation of the holder because shaping of the holder it is preferable to use sheet material with a surface which is as smooth as possible to minimize detrition of the tools.

Figure 2:
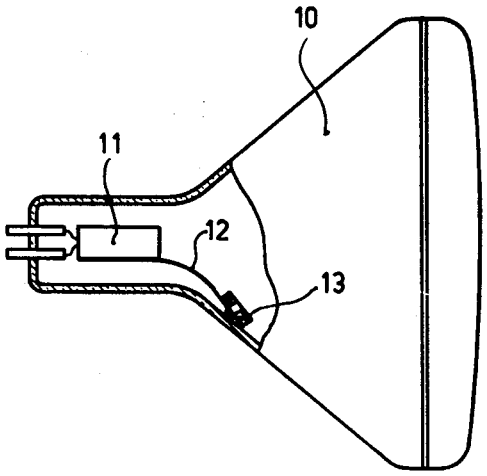

The invention will be described in greater detail with reference to the drawing, in which FIG. 1 is a partial cross-sectional view of a gettering device according to the invention, and FIG. 2 shows a television display tube with a gettering device shown in FIG. 1.

The gettering device shown in FIG. 1 comprises an angular chromium-nickel-steel gutter 1 made from 0.25 mm thick sheet material. The gutter is 2 mm deep, 5 mm wide and has an outside diameter of 25 mm. A powdered mixture 2 of one part by weight of $BaAl_4$ and one part by weight of Ni is compressed in the gutter to which mixture is added 0.5% by weight of $TiH_2$ with respect to the overall weight. The upright walls 6 and 7 of the gutter each have two grooves 3, 4 and 3', 4' which have a depth of approximately 40 $\mu$m and extend in a plane parallel to the bottom plane 5 of the holder. The grooves ensure a good locking of the filling in the holder and they are pressed in the sheet material prior to shaping the holder by means of a die.

Good locking of the filling in the holder can also be obtained with a holder whose inner surface has been roughened. Good results have been obtained with a holder having a surface roughness of approximately 1 $\mu$m obtained by sand-blasting or by chemical treatment, for example, by pickling the holder with a solution of ferrichloride in hydrochloric acid.

The invention is not restricted to cases in which the powdered mixture is compressed into a body in the getter holder itself. It is also possible to use a precompressed filling which is postcompressed after introduction into the holder.

The television display tube shown in FIG. 2, comprises a glass envelope 10 in which is mounted an electron gun 11 shown diagrammatically in the drawing. A metal strip 12 is welded to the electron gun and at the end thereof is secured a gettering device 13 such as that described with reference to FIG. 1. After evacuation of the tube the barium is evaporated by high frequency heating from the mixture compressed in the holder. The evaporation process is accelerated by an exothermal reaction between the barium-aluminium and the nickel, the aluminium binding to the nickel and the metal of the holder. A short time before and during the evaporation of the barium, the quantity of $TiH_2$ added to the gettering mixture decomposes. The released hydrogen gas operates as a scattering medium on the evaporating barium. The hydrogen gas itself with the residual gases remaining in the tube is taken up again by the layer of barium thus formed.

What is claimed is:

1. A getter device comprising a metal holder comprising sidewall and bottom portions shaped to form at least one open cavity having a mainly U-shaped cross-section and compressed vaporative gettering material disposed in said cavity; and shallow indentations extending peripherally into surface areas of said sidewall portions facing inwardly of said cavity, said indentations comprising means to interlock with and hold said gettering material in said cavity during flashing of said gettering material, the depth of said indentations being substantially less than the thickness of said sidewall portions, and outwardly facing surface areas of the same sidewall portions being free from outward projections complementary to said indentations.

2. A getter device as claimed in claim 1 in which the depth of said indentations is less than a few tenths of the thickness of said sidewall portions.

3. A getter device as claimed in claim 2 in which the depth of said indentations is greater than approximately 0.5 $\mu$m.

4. A getter device comprising a metal holder comprising a bottom wall portion and two spaced sidewall portions having a thickness of approximately 0.25mm and extending in the same direction from said bottom wall portion to define, with said bottom wall portion, a cavity having a generally U-shaped cross-section and compressed powdered vaporative gettering material disposed in said cavity; the inner surface of one of said sidewall portions having a groove extending substantially parallel to said bottom wall portion and having a depth of approximately 40 μm, said groove comprising means to hold said getting material in said cavity during flashing of said vaporative gettering material, the outwardlyfacing surface of said one of said sidewall portions in which said groove is formed being free of an outward projection complementary in shape and location to said groove.

5. A getter device comprising an annular sheet metal holder formed to comprise a bottom in the form of an annulus and sidewall portions bent from the radially inward and outward edges of said annulus to define, therewith, an annular cavity with a U-shaped cross-section compressed powder comprising vaporative gettering material disposed in said cavity; and indentations in the surface of one of said sidewall portions facing inwardly of said cavity, said indentations comprising means to hold said compressed powder within said cavity during flashing of said gettering material, the surface of said one of said sidewall portions facing away from said cavity being free to deformations congruent with said indentations.

6. A getter device comprising a metal holder having side-wall and bottom portions shaped to form at least one open cavity having a generally U-shaped cross-section and compressed powdered vaporative gettering material disposed in said cavity, the inner surface of said sidewall portions facing said cavity having a sandblasted or chemically roughened areas forming shallow indentations for interlocking with and holding said gettering material in place during flashing thereof, the outer surface of said sidewall portions being relatively smooth and free from outward projections complementary to said indentations.

* * * * *

UNITED STATES PATENT OFFICE

CERTIFICATE OF CORRECTION

Patent No. 4,128,782 Dated December 5, 1978

Inventor(s) JAN J. B. FRANSEN et al.

It is certified that error appears in the above-identified patent and that said Letters Patent are hereby corrected as shown below:

Column 4, line 1, after "tion" insert --and--
line 8, after "free" delete "to" and insert --of--

Signed and Sealed this

First Day of May 1979

[SEAL]

Attest:

RUTH C. MASON
*Attesting Officer*

DONALD W. BANNER
*Commissioner of Patents and Trademarks*